US011639810B2

(12) United States Patent
Schwartz et al.

(10) Patent No.: US 11,639,810 B2
(45) Date of Patent: May 2, 2023

(54) AIR HANDLING SYSTEM AND METHOD WITH ANGLED AIR DIFFUSER

(71) Applicant: Mitsubishi Electric US, Inc., Cypress, CA (US)

(72) Inventors: Brian Franklin Schwartz, Greenville, SC (US); Joseph Paul Bush, Lawrenceville, GA (US)

(73) Assignee: MITSUBISHI ELECTRIC US, INC., Cypress, CA (US)

( * ) Notice: Subject to any disclaimer, the term of this patent is extended or adjusted under 35 U.S.C. 154(b) by 64 days.

(21) Appl. No.: 17/489,217

(22) Filed: Sep. 29, 2021

(65) Prior Publication Data

US 2023/0098955 A1 Mar. 30, 2023

(51) Int. Cl.
*F24F 13/08* (2006.01)
*F24F 3/044* (2006.01)

(52) U.S. Cl.
CPC ..... *F24F 13/08* (2013.01); *F24F 3/044* (2013.01)

(58) Field of Classification Search
CPC .. F24F 13/08; F24F 3/044; F24F 13/00; F24F 7/065; F04D 29/4206; F04D 29/281; F25D 17/06
See application file for complete search history.

(56) References Cited

U.S. PATENT DOCUMENTS

| | | | | |
|---|---|---|---|---|
| 3,112,623 | A * | 12/1963 | Crossman | F24F 1/0323 62/426 |
| 3,374,831 | A * | 3/1968 | Sieverding | F04D 29/441 165/122 |
| 7,581,619 | B1 | 9/2009 | Storm | |
| 7,604,043 | B2 * | 10/2009 | Higashida | F24F 1/0022 165/122 |
| 8,911,286 | B1 | 12/2014 | Savigny | |
| 9,057,553 | B1 * | 6/2015 | Metzger | F24F 3/044 |
| 10,047,756 | B2 * | 8/2018 | Yang | F04D 25/08 |
| 2012/0168133 | A1 * | 7/2012 | Logan | F24F 3/0442 29/890.03 |
| 2014/0053591 | A1 | 2/2014 | Shin et al. | |
| 2015/0068211 | A1 | 3/2015 | Rodriguez | |
| 2016/0281739 | A1 | 9/2016 | Nakagawa et al. | |
| 2018/0023588 | A1 * | 1/2018 | Van Der Kooi | F04D 29/283 415/203 |
| 2019/0316790 | A1 | 10/2019 | Goto et al. | |

* cited by examiner

*Primary Examiner* — Syed O Hasan
(74) *Attorney, Agent, or Firm* — Posz Law Group, PLC

(57) ABSTRACT

An air handler, comprising: a heating and cooling coil to exchange heat with input air to generate conditioned air; an air diffuser to diffuse the conditioned air to generate diffused air; and an air blower to draw the input air into the air handler via an air inlet, pass the input air over the heating and cooling coil, pass the conditioned air through the diffuser, and expel the diffused air through an air outlet as output air, wherein the air diffuser contains one or more baffles to create two or more air passages that operate to control the expansion and reduction of kinetic energy of the conditioned air to generate the diffused air, a first direction represents a direction of a shortest line between the air blower and the outlet, the air diffuser passes air in a second direction displaced from the first direction by a deflection angle.

16 Claims, 6 Drawing Sheets

AIR HANDLING SYSTEM AND METHOD WITH ANGLED AIR DIFFUSER

TECHNICAL FIELD

The disclosed devices and methods relate generally to an air handling system such as an air-conditioner that heats or cools air in a larger air-conditioning system. More particularly, the disclosed devices and methods relate to an air handler that includes an air diffuser to control the expansion and conversion of kinetic energy of air passing through the air handler to even out the flow of air throughout the air handler, thereby reducing flow resistance, increasing the static pressure of air processed by the air handler, and reducing the power requirements of the air handler.

BACKGROUND

An air handler is a device that draws in air from a room or an outside environment, conditions the air (e.g., heats or cools the air), and passes the conditioned air to a target location at a set point temperature. The air handler will typically contain a fan that operates to push or pull the air through the air handler.

In order to achieve sufficient heating and cooling for a target location, the fan in the air handler must circulate a certain amount of air over a given period of time and must also raise the static pressure of that air after it is conditioned to a sufficient level to allow the air to circulate through the ductwork associated with the larger air-conditioning system at the target location. Typically, the fan in an air handler requires significant power input to raise the discharge static pressure of its output air. Furthermore, a centrifugal fan, which is commonly used in air handlers, causes an increase the air speed of the air passing through the air handler. Within the fan, some of the speed is converted into static pressure but not all.

When the air is discharged from the fan, there is typically still significant kinetic energy that has not been converted into static pressure. As a result of this, when air is discharged from a fan into an open duct, much of the remaining speed (kinetic energy) is wasted as eddies and vortices form in the ducts and dissipate this energy. This wasted energy translates into wasted power and can require increased power expenditures to operate the fan at a higher speed (and thus power) to achieve the required air pressure in the air handler.

It is therefore desirable to minimize the air kinetic energy lost in the air handler by eddies and vortices, thereby improving the power efficiency of the fan in the air handler.

SUMMARY OF THE INVENTION

According to one or more embodiments, an air handler is provided, comprising: an air inlet configured to pass input air into the air handler; a heating and cooling coil configured to exchange heat with the input air as the input air passes over the heating and cooling coil to generate conditioned air; an air diffuser configured to diffuse the conditioned air to generate diffused air; an air outlet configured to expel the diffused air as outlet air; an air blower configured to draw the input air into the air handler, pass the input air over the heating and cooling coil, pass the conditioned air through the diffuser, and expel the diffused air through the air outlet as output air; and an air-handler controller configured to control operation of the heating and cooling coil and the air blower, wherein the air diffuser contains one or more baffles configured to create two or more air passages, the air passages being configured to control the expansion and reduction of kinetic energy of the conditioned air to generate the diffused air, a first direction represents a direction of a shortest line between the air blower and the outlet, the air diffuser is further configured such that air passing through the air diffuser passes in a second direction displaced at from the first direction by a deflection angle, and the deflection angle may be greater than 5°.

The air handler may further comprise: a heater coil located between the air diffuser and the outlet and configured to heat the diffused air before providing it as outlet air.

The output of the air blower may be tilted at a blower tilt angle from a direction perpendicular to the first direction such that the conditioned air blown from the air blower flows in a third direction that is the blower tilt angle from the first direction, and the blower tilt angle may be greater than 0°.

The blower tilt angle may be the same as the deflection angle.

The deflection angle may be between 10° and 30°.

The third direction may be the same as the second direction.

A diffuser angle between a first wall of the air diffuser and a second wall of the air diffuser may be between 20° and 50°, the one or more baffles may be arranged between the first wall and the second wall such that the two or more air passages each define a corresponding passage angle, and a sum of all the passage angles may equal the diffuser angle.

The corresponding passage angles may all be equivalent or at least two of the corresponding passage angles may be different.

The air diffuser and the blower may be formed as separate devices or the air diffuser and the blower are formed may be a unified device.

An air handler is provided, comprising: an air inlet configured to pass input air into the air handler; a heating and cooling coil configured to exchange heat with the input air as the input air passes over the heating and cooling coil to generate conditioned air; an air diffuser configured to diffuse the conditioned air to generate diffused air; an air outlet configured to expel the diffused air as outlet air; an air blower configured to draw the input air into the air handler, pass the input air over the heating and cooling coil, pass the conditioned air through the diffuser, and expel the diffused air through the air outlet as output air; and an air-handler controller configured to control operation of the heating and cooling coil and the air blower, wherein a first direction represents a direction of a shortest line between the air blower and the outlet, the air diffuser is further configured such that air passing through the air diffuser passes in a second direction displaced from the first direction by a deflection angle, an output of the air blower is tilted at a blower tilt angle from a direction perpendicular to the first direction such that the conditioned air blown from the air blower flows in a third direction that is the blower tilt angle from the first direction, the air diffuser configured to divide flow of the conditioned air to generate the diffused air, the blower tilt angle may be greater than 0°, and the deflection angle may be greater than 5°.

The third direction may be the same as the second direction.

The air handler may further comprise: a heater coil located between the air diffuser and the outlet and configured to heat the diffused air before providing it as outlet air.

The blower tilt angle may be greater than 10°.

The blower tilt angle may be the same as the deflection angle.

The deflection angle may be between 10° and 30°.

A diffuser angle between a first wall of the air diffuser and a second wall of the air diffuser may be between 20° and 50°.

A method for operating an air handler is provided, the method comprising: drawing input air into the air handler through an air inlet; conditioning the input air to generate conditioned air; diffusing the conditioned air to create diffused air while passing the conditioned air from an air blower to an air outlet; expelling the diffused air as output air through the air outlet, wherein a first direction represents a direction of a shortest line between the air blower and the outlet, during the operation of diffusing the conditioned air, the conditioned air flows in a second direction displaced at from the first direction by a deflection angle, during the operation of diffusing the conditioned air, the conditioned air is separated into two or more air paths, and the deflection angle may be greater than 5°.

The diffused air may be heated before being passed as the outlet air through the air outlet.

The deflection angle may be between 10° and 30°.

The two or more air paths may run along parallel air passages, each of the parallel air passages defining a corresponding passage angle from a corresponding air passage start to a corresponding air passage end, and a sum of all the passage angles may be between 20° and 50°.

The corresponding passage angles may all be equivalent or at least two of the corresponding passage angles may be different.

BRIEF DESCRIPTION OF THE DRAWINGS

The accompanying figures, where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

Air Handler—First Embodiments

Figure 1:
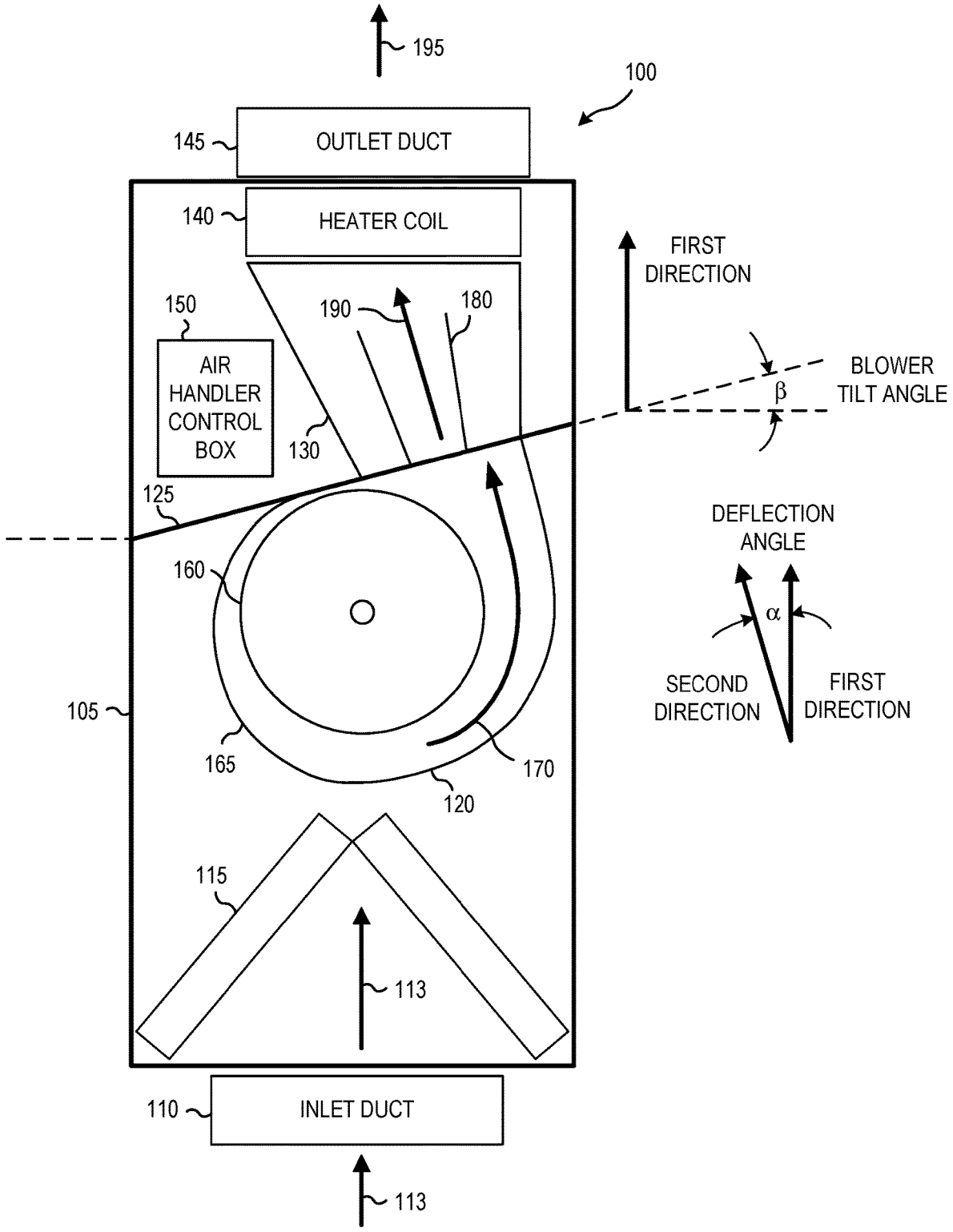
FIG. 1 is a diagram of an air handler according to first disclosed embodiments.

FIG. 1 is a diagram of an air handler 100 according to first disclosed embodiments. As shown in FIG. 1, the air handler 100 includes an air handler housing 105, an air inlet duct 110, a heating and cooling coil 115, a fan 120, a separation plate 125, an air diffuser 130, a heater coil 140, an outlet duct 145, and an air handler control box 150. The fan 120 further includes a blower 160 and a fan housing 165. The air diffuser 130 may include one or more baffles 180.

The air handler housing 105 is a frame that contains the other components of the air handler 100. The air handler housing 105 serves to protect these components and provide an enclosed avenue for air to pass from the air inlet duct 110 to the air outlet duct 145.

The air inlet duct 110 is an opening in the air handler housing 105 that allows inlet air 113 to enter the air handler housing 105.

The heating and cooling coil 115 is a heat exchange coil that operates to exchange heat between a refrigerant passing through the heating and cooling coil 115 and the inlet air 113 passing over the heating and cooling coil 115 to generate conditioned air 170. In a heating mode the exchange of heat between the heating and cooling coil 115 and the inlet air 113 will heat the inlet air 113, and in a cooling mode the exchange of heat between the heating and cooling coil 115 and the inlet air 113 will cool the inlet air 113.

The fan 120 operates to draw the inlet air 113 into air handler housing 105 via the air inlet duct 110, pass the inlet air 113 through the heating and cooling coil 115 to generate the conditioned air 170, pass the conditioned air 170 through the diffuser 130 to generate diffused air 190, and pass the diffused air 190 through the heater coil 140 and out the outlet duct 145 as outlet air 195.

The fan 120 operates to circulate the air through the air handler housing 105 such that it passes over the heating and cooling coil 115 so that it can be properly conditioned and such that it achieves a sufficient static pressure that the air can properly circulate through the ductwork in the remainder of an air-conditioning system. In the embodiment of FIG. 1, the fan 120 is located between the heating and cooling coil 115 and the separation plate 125. The fan 120 draws in the conditioned air 170 that is conditioned by passing through the heating and cooling coil 115 and blows it through an opening in the separation plate 125 to the air diffuser 130.

In the embodiment of FIG. 1, the fan 120 is a centrifugal fan that includes the blower 160 and a fan housing 165. However, this is by way of example only. Alternate embodiments can employ any suitable fan that moves air from the air inlet duct 110, through the air handler 100, and out the air outlet.

The blower 160 rotates around an axis, draws in the conditioned air 170 (which can be considered first blown air) from the heating and cooling coil 115, and blows the conditioned air 170 through an opening in the separation plate 125 and into the diffuser 130. The discharge air from a centrifugal fan is generally concentrated toward the outer end of the fan output rather than being evenly distributed across the fan output.

The fan housing 165 contains the conditioned air 170 (first blown air) that is being blown by the blower 160 such that the conditioned air 170 (first blown air) is expelled from an opening in the fan housing 165 coincident with a similar opening in the separation plate 125.

The separation plate 125 is a structure located in the air handler housing 105 between the fan 120 and the diffuser 130 that operates to prevent any air from passing from one side of the separation plate 125 to the other in the air handler housing 105 except through an opening in the separation plate 125 coincident with the output of the fan 120. In this way, only the conditioned 170 air expelled from the fan 120 will pass from one side of the separation plate 125 to the other inside the air handler housing 105.

In the embodiment of FIG. 1, the separation plate 125 is tilted by a blower tilt angle β from a line perpendicular to a first direction that represents the shortest line between the inlet duct 110 and the outlet duct 145. The blower tilt angle β can vary in different embodiments but is preferably in the range of 5° to 45°. More preferably, the blower tilt angle β is in a range of 10° to 30°.

Because the separation plate 125 is tilted by the blower tilt angle β, the conditioned air 170 expelled by the fan 120 into the air diffuser 130 will be at an angle from the first direction. The air diffuser 130 may further deflect the conditioned air 170 away from the first direction. In this way, the conditioned air 170 is deflected by a deflection angle α from the first direction. Depending upon how the air diffuser 130 is arranged, the deflection angle α may be the same as the blower tilt angle β or may differ from the blower tilt angle β. By having the conditioned air 170 expelled by the fan 120 into the air diffuser 130 be at a deflection angle α, the conditioned air 170 will be spread in a second direction diagonally across the first direction rather than in a direction parallel to the first direction. This will serve to move the bulk of the flow of the conditioned air 170 toward the center of the air handler 130 rather than allowing it to concentrate on one side of the air handler 130. In doing so, this will allow the air diffuser 130 to better mix the conditioned air 170 as it is transformed into diffused air 190, further reducing the creation of eddies and vortices in the air and making it more efficient for the air handler 100 to increase the static air pressure of the diffused air 190.

The air diffuser 130 receives the conditioned air 170 from the fan 120 and operates to perform a controlled expansion of the conditioned air 170 to generate diffused air 190. This controlled expansion increases the amount of air speed that is converted to static air pressure as compared to a system without the air diffuser 130 attached to the output of the fan 120. In doing so, the air diffuser 130 reduces the air speed needed at the output of the fan 120 to achieve a desired static air pressure. This means that the fan 120 will use less power to achieve the desired static air pressure than a system without the air diffuser 130 attached to the output of the fan 120.

A cross-section of the air diffuser 130 has a trapezoidal shape with the shorter parallel side facing the fan 120 and the longer parallel side facing the outlet duct 145. In other words, an air input for the air diffuser 130 is smaller than an air output of the air diffuser 130 and the air diffuser 130 gradually widens along its length. As a result, an air diffuser 130 can be defined by the angle of this expansion, measured by a hypothetical apex where the two non-parallel sides of the air diffuser 130 would meet if extended toward the fan 120.

In various embodiments, the angle of expansion of the air diffuser 130 can vary between 20° and 45°. However, smaller angles of expansion for air paths in the air diffuser can provide for more advantageous air diffusion. Therefore, the air diffuser 130 can include one or more baffles 180 that break up the air flow through the air diffuser 130 into separate air passages that each have an expansion angle smaller than the expansion angle of the air diffuser 130 as a whole. Generally, the total of the expansion angles of the separate air passages will equal the expansion angle of the air diffuser 130 as a whole. However, this may not be true for some embodiments.

For example, a single 30° air diffuser 130 could have two baffles 180 that create three separate air passages that are 10° each. Many other arrangements are possible by modifying the number and position of the baffles 180. The angles of the air passages created by the baffles 180 in the air diffuser 130 can be the same for each passage or may differ among the passages.

When using a centrifugal fan as the fan 120, the conditioned air 170 discharged from the fan 120 is concentrated toward the outer end of the fan 120. An air diffuser 130 that was relatively short (e.g., six inches) and had no baffles 180 might need an expansion angle as high as 30°, which would not allow for the recovery of significant pressure. However, an air diffuser 130 of the same length but with two baffles 180 could significantly increase pressure recovery by reducing the width and expansion angle of the air passages in the air diffuser 130.

The baffles 180 are plates that operate to divide the space inside the air diffuser 130 into multiple separate air passages. The baffles 180 are formed so that no air can pass through one of the baffles 180 from one air passage to another over the course of the air passage. In various embodiments the baffles 180 can extend over the entire course of the air diffuser 130 from an input opening to an output opening. In other embodiments, the baffles 180 can run less than the entire course of the air baffle 130 from the input opening to the output opening.

Since the separation plate 125 is tilted with respect to a first direction causing the conditioned air 170 output from the fan 120 to be in a second direction that is a deflection angle α from the first direction, the air diffuser 130 is not symmetrical around the first direction. This angling of the conditioned air output from the fan 120 can help reduce the formation of eddies and vortices and increase the pressure of the resulting diffused air as compared to an air diffuser 130 of the same length but which received air in the first direction.

The heater coil 140 is provided to exchange heat with the diffused air 190 prior to it being ejected from the air diffuser 130 through the outlet vent 190 as outlet air 195 (which can be considered second blown air). The heater coil 140 is a heat exchanger that can be used, for example, in a cooling operation in which the conditioned air 170 is brought to a temperature lower than a desired set point to dehumidify the inlet air 113. The heater coil 140 need not be operated in every operation mode and could be eliminated in some alternate embodiments.

The outlet duct 145 is an opening in the air handler housing 105 that allows outlet air 195 to exit the air handler housing 105 after it has been conditioned and diffused. Based on the operation of the fan 120 and the diffuser 130, the outlet air 195 (second blown air) will have a pressure sufficient to pass through the ductwork of the remainder of the air-conditioning system the air handler 100 is a part of and heat or cool the target space.

The air handler control box 150 controls the operation of the air handler 100. It can include a processor that generates signals to control the fan 120 or any other element that requires control signals. The air handler control box 150 can store information in a memory and run instructions stored in the memory. The processor can be a microprocessor (e.g., a central processing unit), an application-specific integrated circuit (ASIC), or any suitable device for controlling the operation of all or part of the air handler 100. The memory can include a read-only memory (ROM), a random-access memory (RAM), an electronically programmable read-only memory (EPROM), an electrically erasable programmable read only memory (EEPROM), flash memory, or any suitable memory device.

Some alternate embodiments can have the air handler control box 150 control more than just the air handler 100. Other alternate embodiments can have the air handler 100 controlled by a controller external to the air handler 100.

Although the embodiment of FIG. 1 shows the fan 120 being located between the heating and cooling coil 115 and the separation plate 125, this is by way of example only. Alternate embodiments could alter the position of the fan 120 so long as it moves air through the air handler 100 in an efficient manner. In embodiments in which the location of the fan 120 is altered, the location of the diffuser 130 would likewise be altered to diffuse the air expelled from the fan 120 such that the formation of eddies and vortices can be reduced.

An exemplary embodiment will show the benefits of this arrangement. For a PVA-5 ton (1900 standard cubic feet per minute flow), the amount of recoverable pressure is 0.73 inWC. A system without the air deflection in the diffuser 130 described above will typically recover 15% of this, resulting in a total loss of 0.62 inWC for the system. In contrast, a system with an angled separation plate 125 and an air diffuser 130 that further deflects the diffused air 190 allows 55% recovery of pressure, resulting in a total loss of pressure of 0.33 inWC. The use of an angled separation plate 125 and an air diffuser 130 that further deflects the diffused air 190 could therefore add a 0.30 inWC improvement in output air handler pressure for this design. This could result in ~20% reduction in required fan power to generate a desired static pressure for the outlet air 195 as compared to an air handler without these features. Such power reduction is significant to both system efficiency and motor selection.

Air Handler—Second Embodiment

Figure 2:
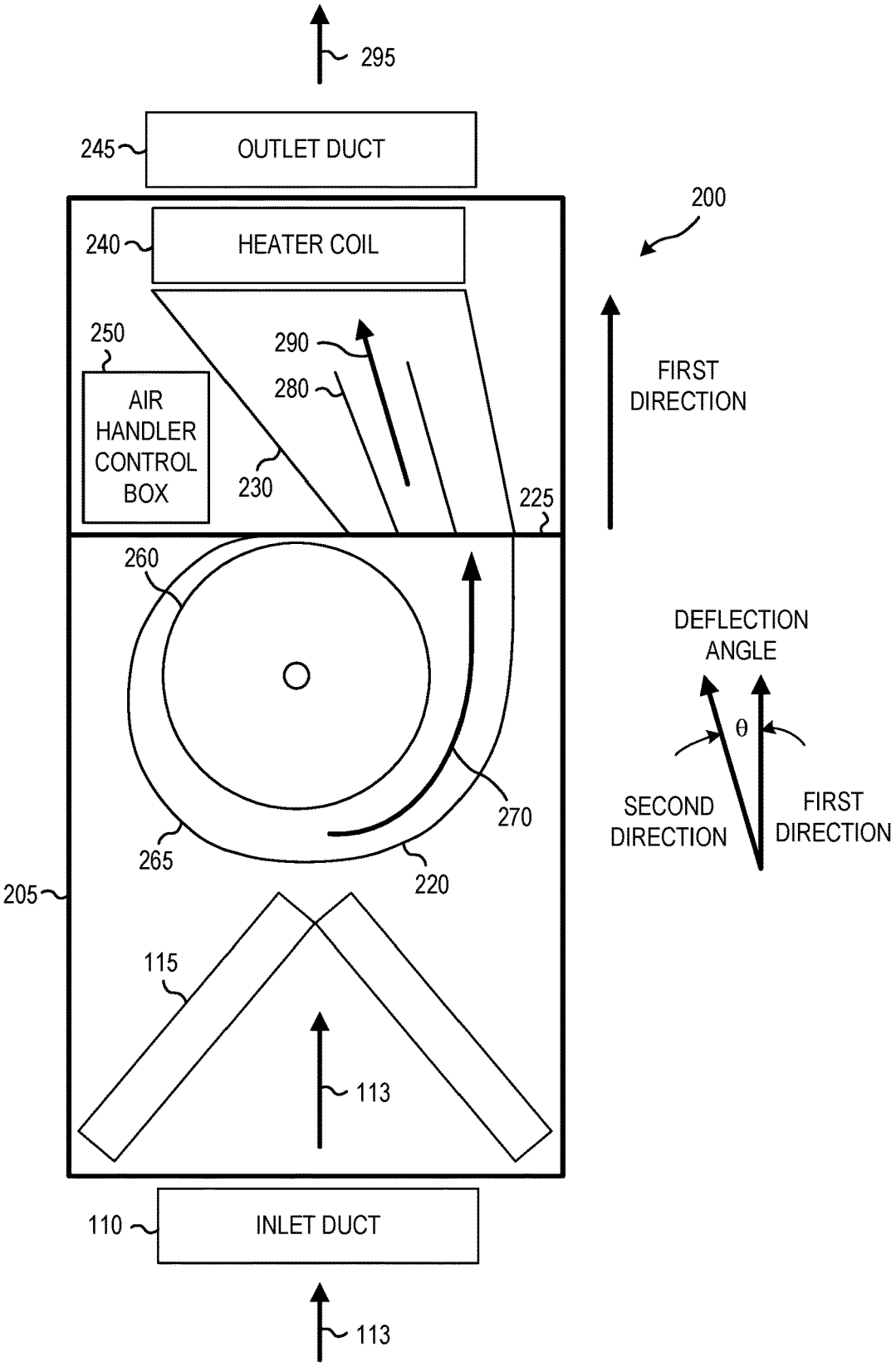
FIG. 2 is a diagram of an air handler according to second disclosed embodiments.

FIG. 2 is a diagram of an air handler 200 according to alternate disclosed embodiments. As shown in FIG. 2, the air handler 200 includes an air handler housing 205, an air inlet duct 110, a heating and cooling coil 115, a fan 220, a separation plate 225, an air diffuser 230, a heater coil 240, an outlet duct 245, an air handler control box 250. The fan 220 further includes a blower 260 and a fan housing 265. The air diffuser 230 may include one or more baffles 280.

The air handler housing 205 is similar in structure and operation to the air handler housing 105 in FIG. 1 save that it is sized to hold the elements that form the air handler 200.

The air inlet duct 110 and the heating and cooling coil 115 operate as described above with respect to the embodiment of FIG. 1.

The fan 220 operates in a manner similar to the fan 120 in the embodiment of FIG. 1, i.e., to draw the inlet air into air handler housing 205 via the air inlet duct 110, pass the inlet air 113 through the heating and cooling coil 115 to generate the conditioned air 270, pass the conditioned air 270 through the diffuser 230 to generate diffused air 290, and pass the diffused air through the heater coil 240 and out the outlet duct 245 as outlet air 295. The fan 220 in the embodiment of FIG. 2 differs from the fan 120 in the embodiment of FIG. 1 in that the separation plate 225 extends perpendicular to the first direction. As a result, the conditioned air 270 blown out of the fan 220 through the opening in the separation plate 225 will initially be blown in the first direction. The fan 220 draws in the conditioned air 270 that is conditioned by passing through the heating and cooling coil 115 and blows it through the opening in the separation plate 225 to the air diffuser 230.

In the embodiment of FIG. 2, the fan is a centrifugal fan that includes the blower 260 and a fan housing 265. However, this is by way of example only. Alternate embodiments can employ any suitable fan that moves air from the air inlet duct 210, through the air handler 200, and out the air outlet. The blower 260 and the fan housing 265 operate in a manner like that of comparably numbered elements in the embodiment of FIG. 1.

The separation plate 225 is a structure located between the fan 220 and the diffuser 230 that operates to prevent any air from passing through it except through an opening coincident with the output of the fan 220. In this way, only the conditioned air 270 expelled from the fan 220 will pass from one side of the separation plate 225 to the other. However, unlike the embodiment of FIG. 1, the separation plate 225 in the embodiment of FIG. 2 extends perpendicular to the first direction, i.e., a blower tilt angle is zero.

Because the separation plate 225 is perpendicular to the first direction, the conditioned air 270 expelled by the fan 220 into the air diffuser 230 will initially be parallel to the first direction. However, the air diffuser 230 is tilted at an angle such that the conditioned air 270 expelled by the fan 220 into the air diffuser 230 will be deflected at a deflection angle $\theta$ from the first direction. By having the conditioned air 270 deflected by the air diffuser 230 to a deflection angle $\theta$, the conditioned air 270 will be spread diagonally across the first direction rather than parallel to the first direction. This will serve to move the bulk of the flow of the conditioned air 270 toward the center of the air handler 230 rather than allowing it to concentrate on one side of the air handler 230. This will allow the air diffuser 230 to better mix the conditioned air 270 as it is transformed into diffused air 290, further reducing the creation of eddies and vortices in the air and making it more efficient for the air handler 200 to increase the static air pressure of the diffused air 290. Thus, in the second embodiment the air diffuser 230 alone is responsible for the deflection angle $\theta$ of the diffused air 290 rather than a deflection angle $\alpha$ being a result of both the blower tilt angle $\beta$ and the structure of the air diffuser 130 in the first embodiment.

The air diffuser 230 receives the conditioned air 270 from the fan 220 and operates to perform a controlled expansion of the conditioned air to generate diffused air 290. This controlled expansion increases the amount of air speed that is converted to static air pressure as compared to a system without the air diffuser 230 attached to the output of the fan 220. In doing so, the air diffuser 230 reduces the air speed needed at the output of the fan 220 to achieve a desired static air pressure. This means that the fan 220 will use less power to achieve the desired static air pressure than a system without the air diffuser 230 attached to the output of the fan 220.

A cross-section of the air diffuser 230 has a trapezoidal shape with the shorter parallel side facing the fan 220 and the longer parallel side facing the outlet duct 245. In other words, an air input for the air diffuser 230 is smaller than an air output of the air diffuser 230 and the air diffuser 230 gradually widens along its length. As a result, an air diffuser 230 can be defined by the angle of this expansion, measured by a hypothetical apex where the two non-parallel sides of the air diffuser 230 would meet if extended toward the fan 220.

In various embodiments, the angle of expansion of the air diffuser 230 can vary between 20° and 45°. However, smaller angles of expansion for air paths in the air diffuser can provide for more advantageous air diffusion. Therefore, the air diffuser 230 can include one or more baffles 280 that break up the air flow through the air diffuser 230 into separate air passages that each have an expansion angle smaller than the expansion angle of the air diffuser 230 as a whole. For example, a single 30° air diffuser 230 could have two baffles 280 that create three separate air passages that are 10° each. Many other arrangements are possible by modifying the number and position of the baffles 280. The angles of the air passages created by the baffles 280 in the air diffuser 230 can be the same for each passage or may differ among the passages.

For example, when using a centrifugal fan as the fan 220, the conditioned air 270 discharged from the fan 220 is concentrated toward the outer end of the fan 220. An air diffuser 230 that was relatively short (e.g., six inches) and had no baffles 280 might have to have an expansion angle as high as 30°, which would not allow for the recovery of significant pressure. However, an air diffuser 230 of the same length but with two baffles 280 could significantly increase pressure recovery by reducing the width of the air passages in the air diffuser 230.

The baffles 280 are configured and operate similarly to the baffles 180 in the first embodiment save that they may be oriented or arranged differently resulting in differently shaped air passages.

Although the separation plate 225 is perpendicular to the first direction, the air diffuser 230 is still not symmetrical around the first direction since it is configured to deflect the diffused air 290 by the deflection angle θ. This angling of the conditioned air output from the fan 220 can help reduce the formation of eddies and vortices and increase the pressure of the resulting diffused air as compared to an air diffuser 230 of the same length but which received air in the first direction.

The heater coil 240, the outlet duct 245, and the air handler control box 250 operate in manners comparable to the heater coil 140, the outlet duct 145, and the air handler control box 150 in the first embodiment. As with the first embodiment, the heater coil 240 need not be operated in every operation mode and could be eliminated in some alternate embodiments.

Although the embodiment of FIG. 2 shows the fan 220 being located between the heating and cooling coil 115 and the separation plate 225, this is by way of example only. Alternate embodiments could alter the position of the fan 220 so long as it moves air through the air handler 200 in an efficient manner. In embodiments in which the location of the fan 220 is altered, the location of the diffuser 230 would likewise be altered to diffuse the air expelled from the fan 220 such that the formation of eddies and vortices can be reduced.

Diffusers

Figure 3:
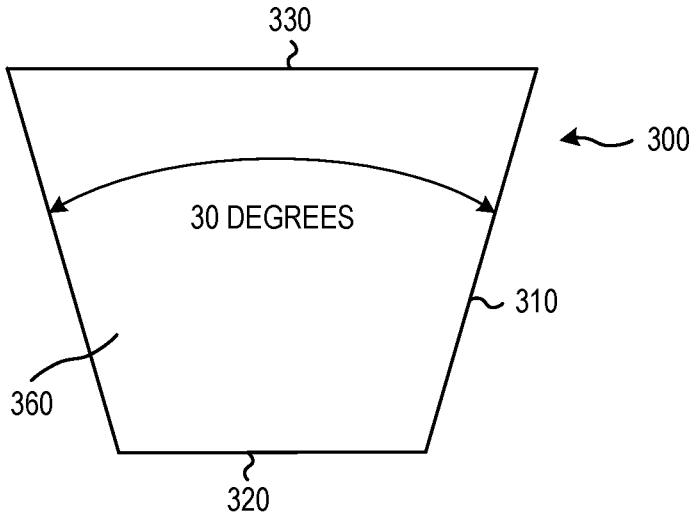
FIG. 3 is a diagram of a thirty-degree diffuser with no baffles according to disclosed embodiments.

FIG. 3 is a diagram of a thirty-degree diffuser 300 with no baffles according to disclosed embodiments. As shown in FIG. 3, the diffuser 300 is defined by a diffuser housing 310 and has a diffuser air inlet 320 and a diffuser air outlet 330.

The diffuser housing 310 has a trapezoidal cross-section with an expansion angle of 30° between the two nonparallel walls of its cross-section. The expansion of the diffuser 300 will cause air flowing through it to recover some pressure from the air as it passes through the diffuser.

The diffuser air inlet 320 is formed at the smaller of the parallel sides of the cross-section. The diffuser air inlet 320 is positioned where air that needs to be diffused will enter the diffuser 300.

The diffuser air outlet 330 is formed at the larger of the parallel sides of the cross-section. The diffuser air outlet 330 is positioned where air that has been diffused by the diffuser 300 will exit the diffuser 300.

Figure 4:
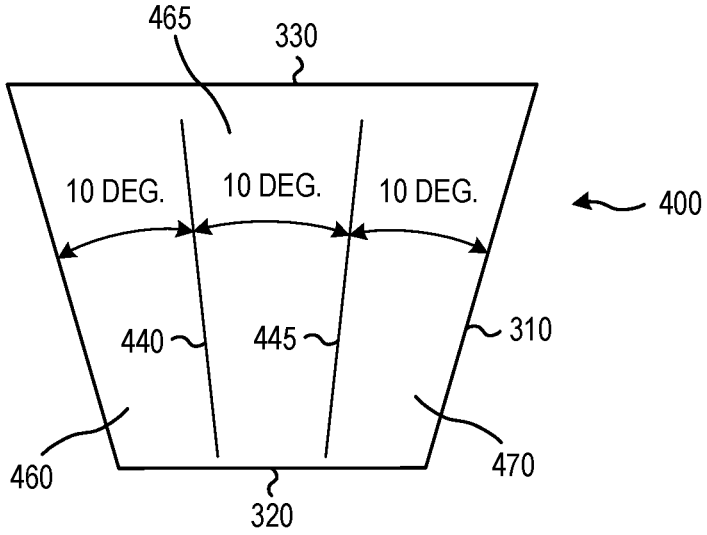
FIG. 4 is a diagram of a thirty-degree diffuser with evenly arranged baffles according to disclosed embodiments.

FIG. 4 is a diagram of a thirty-degree diffuser 400 with evenly arranged baffles 440, 445 according to disclosed embodiments. As shown in FIG. 4, the diffuser 400 is defined by a diffuser housing 310 and has a diffuser air inlet 320, and a diffuser air outlet 330. Two baffles 440, 445 are formed inside the diffuser 400.

The diffuser housing 310, the diffuser air inlet 320, the diffuser air outlet 330 are configured as described above with respect to the diffuser 300 of FIG. 3.

The diffuser 400 has an expansion angle of 30° between the two nonparallel walls of its cross-section. The diffuser 400 also has two evenly arranged baffles 440, 445 that create first, second, and third air passages 460, 465, 470 inside the diffuser 400. Since the baffles 440, 445 are evenly arranged, the expansion angles of the air passages 460, 465, 470 are likewise equal. Specifically, the expansion angle of each air passage 460, 465, 470 is 10°.

Because each air passage 460, 465, 470 has a smaller expansion angle than the diffuser 400 in general, the diffused air passing through each individual air passage 460, 465, 470 will recover a greater amount of pressure as compared to a diffuser 300 with no baffles of a similar length. This will result in a greater static air pressure of the air exiting the diffuser 400 when the air from the three air passages 460, 465, 470 are combined.

Because the conditioned air output from a fan in an air handler may not be uniform over the output vent of the fan, the precise configuration and number of the baffles in a diffuser to configure air passages that will maximize the amount of pressure recovery from the operation of the diffuser may vary among different air handlers. However, it will be possible to test an individual air handler design to determine what number, placement, and arrangement of baffles would create a set of air passages that will maximize the amount of pressure recovery. Once the precise arrangement is determined by testing, an appropriate air handler can be created for the particular air handler. Such an air handler may not have air passages whose expansion angles are the same.

Figure 5:
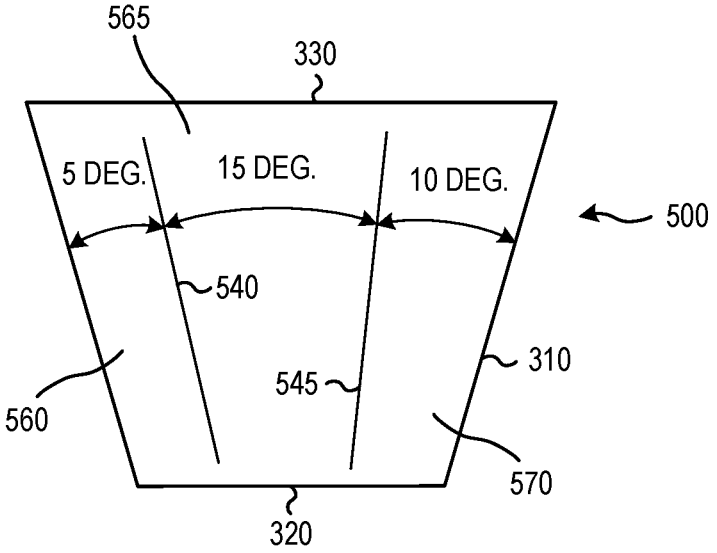
FIG. 5 is a diagram of a thirty-degree diffuser with unevenly arranged baffles according to disclosed embodiments.

FIG. 5 is a diagram of a thirty-degree diffuser 500 with unevenly arranged baffles 540, 545 according to disclosed embodiments. As shown in FIG. 5, the diffuser 500 is defined by a diffuser housing 310 and has a diffuser air inlet 320, and a diffuser air outlet 330. Two baffles 540, 545 are formed inside the diffuser 500.

The diffuser housing 310, the diffuser air inlet 320, the diffuser air outlet 330 are configured as described above with respect to the diffuser 300 of FIG. 3.

The diffuser 500 has an expansion angle of 30° between the two nonparallel walls of its cross-section. The diffuser 500 also has two unevenly arranged baffles 540, 545 that create first, second, and third air passages 560, 565, 570 inside the diffuser 500. Since the baffles 540, 545 are unevenly arranged, the expansion angles of the air passages 560, 565, 570 are not equal. Specifically, a first expansion angle of a first air passage 560 is 50, a second expansion angle of a second air passage 565 is 15°, and a third expansion angle of a third air passage 570 is 10°.

Because each air passage 560, 565, 570 has a smaller expansion angle than the diffuser 500 in general, the diffused air passing through each individual air passage 560, 565, 570 will recover a greater amount of pressure as compared to a diffuser 300 with no baffles of a similar length. This will result in a greater static air pressure of the air exiting the diffuser 500 when the air from the three air passages 560, 565, 570 are combined.

However, this is by way of example only to show how a diffuser 500 with uneven baffles 540, 545 might be arranged. The specific placement of the baffles 540, 545 and the expansion angles of the resulting air passages 560, 565, 570 can vary with each separate air handler design.

Figure 6:
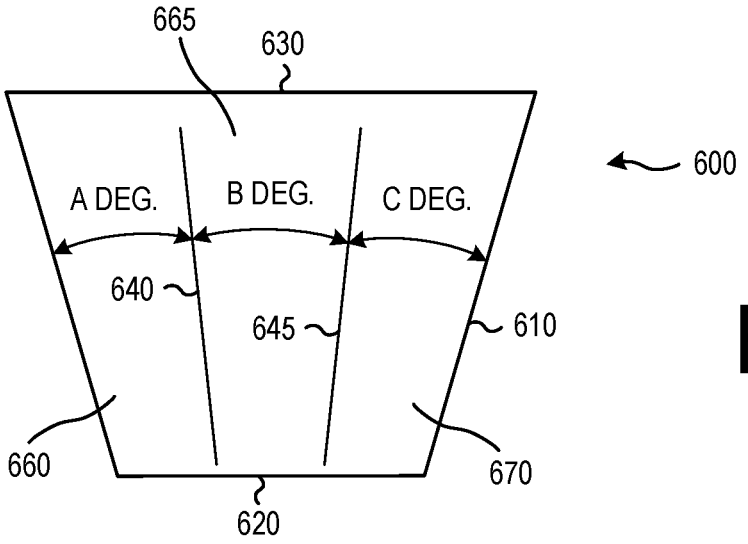
FIG. 6 is a diagram of a diffuser with two baffles according to disclosed embodiments.

FIG. 6 is a diagram of a diffuser 600 with two baffles 640, 645 according to disclosed embodiments. As shown in FIG. 6, the diffuser 600 is defined by a diffuser housing 610 and has a diffuser air inlet 620, and a diffuser air outlet 630. Two baffles 640, 645 are formed inside the diffuser 600.

FIG. 6 is like FIGS. 4 and 5 in construction and operation and elements in FIG. 6 operate similarly to comparable elements in FIGS. 4 and 5.

FIG. 6 discloses that for any given diffuser 600 of a given expansion angle, a number of baffles 640, 645 can be provided that divide the space inside the diffuser 600 into multiple, separate air passages 660, 665, 670 of varying expansion angles. A first air passage 660 is A°, a second air passage 665 is B°, and a third air passage 670 is C°. The values for A, B, and C can vary between different air handler designs.

Because each air passage 660, 665, 670 has a smaller expansion angle than the diffuser 600 in general, the diffused air passing through each individual air passage 660, 665, 670 will recover a greater amount of pressure as compared to a diffuser 300 with no baffles of a similar length. This will result in a greater static air pressure of the air exiting the diffuser 600 when the air from the three air passages 660, 665, 670 are combined.

Although FIG. 6 discloses an air diffuser 600 with two baffles 640, 645, this is by way of example only. More or fewer baffles can be used in alternate embodiments.

Figure 7:
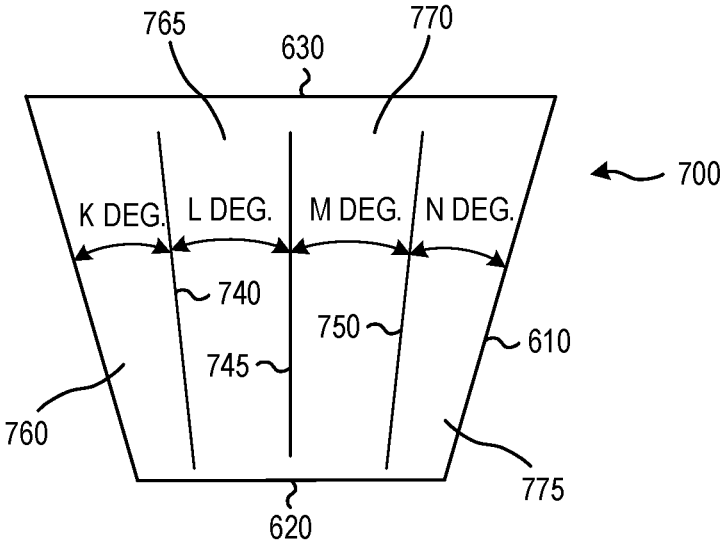
FIG. 7 is a diagram of a diffuser with three baffles according to disclosed embodiments.

FIG. 7 is a diagram of a diffuser 700 with three baffles 740, 745, 750 according to disclosed embodiments. As shown in FIG. 7, the diffuser 700 is defined by a diffuser housing 610 and has a diffuser air inlet 620, and a diffuser air outlet 630. Three baffles 740, 745, 750 are formed inside the diffuser 700.

FIG. 7 is like FIG. 6 in construction and operation and elements in FIG. 7 operate similarly to comparable elements in FIG. 6.

FIG. 7 discloses that for any given diffuser 700 of a given expansion angle, a number of baffles 740, 745, 750 can be provided that divide the space inside the diffuser 700 into multiple, separate air passages 760, 765, 770, 775 of varying expansion angles. A first air passage 760 is K°, a second air passage 765 is L°, a third air passage 770 is M°, and a fourth air passage 775 is N°. The values for K, L, M, and N can vary between different air handler designs.

Because each air passage 760, 765, 770, 775 has a smaller expansion angle than the diffuser 700 in general, the diffused air passing through each individual air passage 760, 765, 770, 775 will recover a greater amount of pressure as compared to a diffuser 300 with no baffles of a similar length. This will result in a greater static air pressure of the air exiting the diffuser 500 when the air from the four air passages 760, 765, 770, 775 are combined.

FIG. 7 specifically shows an example using three baffles 740, 745, 750 that create four separate air passages 760, 765, 770, 775. Again, this is by way of example only. More or fewer baffles can be used in alternate embodiments.

Figure 8:
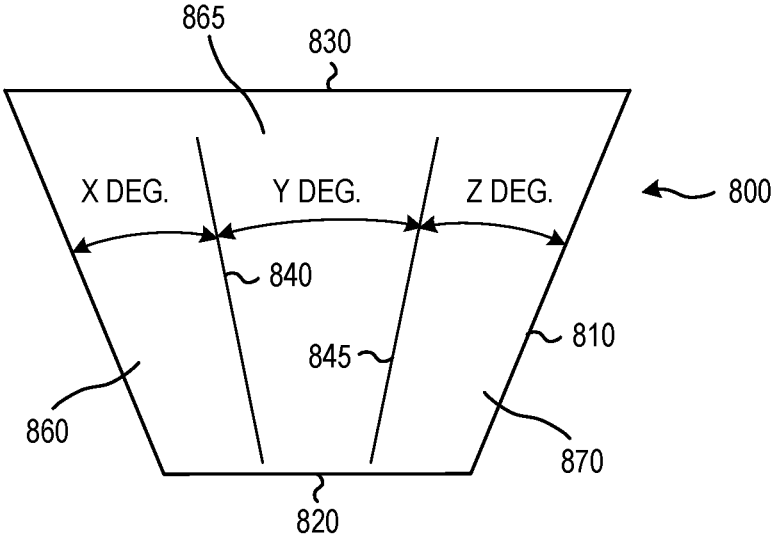
FIG. 8 is a diagram of a diffuser with two baffles according to disclosed embodiments.

FIG. 8 is a diagram of a diffuser 800 with two baffles 840, 845 according to disclosed embodiments. As shown in FIG. 8, the diffuser 800 is defined by a diffuser housing 810 and has a diffuser air inlet 820, and a diffuser air outlet 830. Two baffles 840, 845 are formed inside the diffuser 800.

FIG. 8 is like FIG. 6 in construction and operation and elements in FIG. 8 operate similarly to comparable elements in FIG. 6.

FIG. 8 discloses a diffuser 800 that is wider than the diffuser 600 of FIG. 6. It is intended to show, by way of example, that the precise expansion angle of a diffuser may vary among different embodiments. The diffuser 800 has multiple baffles 840, 845 that divide the space inside the diffuser 800 into multiple, separate air passages 860, 865, 870 of varying expansion angles. A first air passage 860 is X°, a second air passage 865 is Y°, and a third air passage 870 is Z°. The values for X, Y, and Z can vary between different air handler designs.

Because each air passage 860, 865, 870 has a smaller expansion angle than the diffuser 800 in general, the diffused air passing through each individual air passage 860, 865, 870 will recover a greater amount of pressure as compared to a diffuser 300 with no baffles of a similar length. This will result in a greater static air pressure of the air exiting the diffuser 800 when the air from the three air passages 860, 865, 870 are combined.

The air diffusers 300, 400, 500, 600, 700, 800 are intended to illustrate design features that may form a part of any of the air diffusers discussed in this disclosure. Although the air diffusers 300, 400, 500, 600, 700, 800 in FIGS. 3-8 may appear symmetrical along a line perpendicular to both parallel sides, these drawings are not intended to show the precise angles of the nonparallel walls or baffles of the air diffusers 300, 400, 500, 600, 700, 800. As noted above, the air diffusers 300, 400, 500, 600, 700, 800 may not be symmetrical around a line perpendicular to both parallel sides. Instead, they may be tilted such that the diffused air 290 is deflected at a desired deflection angle $\alpha$.

Air Handler—Third Embodiment

Figure 9:
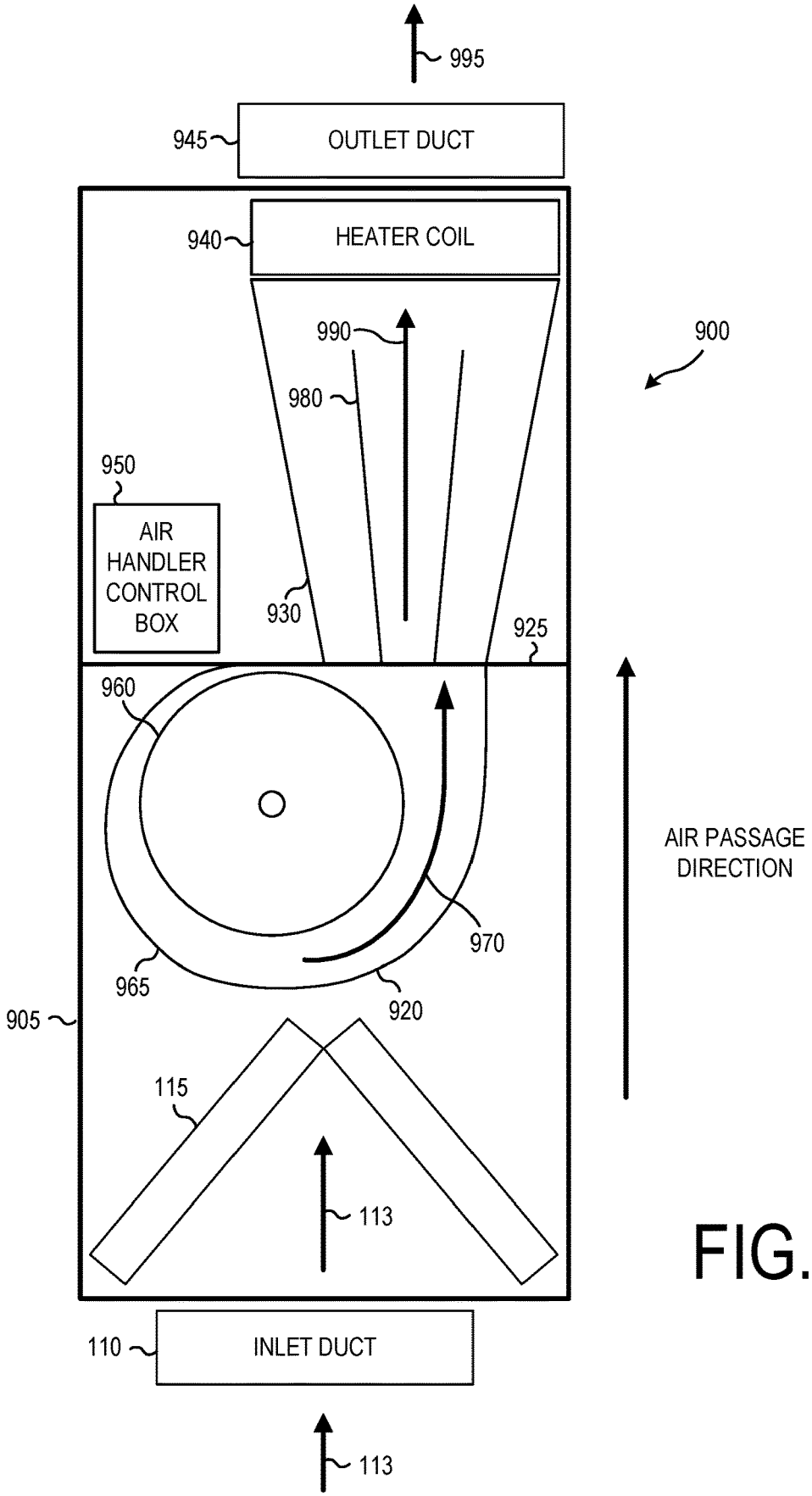
FIG. 9 is a diagram of an air handler according to third disclosed embodiments.

FIG. 9 is a diagram of an air handler 900 according to another alternate disclosed embodiments. As shown in FIG. 9, the air handler 900 includes an air handler housing 905, an air inlet duct 110, a heating and cooling coil 115, a fan 920, a separation plate 925, an air diffuser 930, a heater coil 940, an outlet duct 945, an air handler control box 950. The fan 920 further includes a blower 960 and a fan housing 965. The air diffuser 930 may include one or more baffles 980.

The air handler housing 905 is similar in structure and operation to the air handler housing 105 in FIG. 1 save that it is sized to hold the elements that form the air handler 900.

The air inlet duct 110 and the heating and cooling coil 115 operate as described above with respect to the embodiment of FIG. 1.

The fan 920 operates in a manner similar to the fan 120 in the embodiment of FIG. 1, i.e., to draw the inlet air 113 into air handler housing 105 via the air inlet duct 110, pass the inlet air 113 through the heating and cooling coil 115 to generate the conditioned air 970, pass the conditioned air 970 through the diffuser 930 to generate diffused air 990, and pass the diffused air through the heater coil 940 and out the outlet duct 945 as outlet air 995.

The fan 920 in the embodiment of FIG. 2 differs from the fan 120 in the embodiment of FIG. 1 in that the separation plate 925 extends perpendicular to the first direction and the air diffuser 930 does not deflect the diffused air 990 away from the first direction. As a result, the conditioned air 970 blown out of the fan 920 through the opening in the separation plate 925 will be blown in the first direction. The fan 920 draws in the conditioned air 970 that is conditioned by passing through the heating and cooling coil 115 and blows it through the opening in the separation plate 925 to the air diffuser 930.

In the embodiment of FIG. 9, the fan is a centrifugal fan that includes the blower 960 and a fan housing 965. However, this is by way of example only. Alternate embodiments can employ any suitable fan that moves air from the air inlet duct 110, through the air handler 900, and out the air outlet. The blower 960 and the fan housing 965 operate in a manner like that of comparably numbered elements in the embodiment of FIG. 1.

The separation plate 925 is a structure located between the fan 920 and the diffuser 930 that operates to prevent any air from passing through it from one side of the air handler housing 905 to the other except through an opening in the separation plate 925 coincident with the output of the fan 920. In this way, only the conditioned air 970 expelled from the fan 920 will pass from one side of the separation plate 925 to the other. However, unlike the embodiment of FIG. 1, the separation plate 925 in the embodiment of FIG. 9 extends perpendicular to the first direction. Because the separation plate 925 is perpendicular to the first direction, the conditioned air 970 expelled by the fan 920 into the air diffuser 930 will be parallel to the first direction.

The air diffuser 930 receives the conditioned air 970 from the fan 920 and operates to perform a controlled expansion of the conditioned air to generate diffused air 990. This controlled expansion increases the amount of air speed that is converted to static air pressure as compared to a system without the air diffuser 930 attached to the output of the fan 920. In doing so, the air diffuser 930 reduces the air speed needed at the output of the fan 920 to achieve a desired static air pressure. This means that the fan 920 will use less power to achieve the desired static air pressure than a system without the air diffuser 930 attached to the output of the fan 920, the air diffuser 930 is configured such that it does not deflect the diffused air 990 from the first direction. In other words, the diffused air 990 will continue through the air diffuser 930 in the first direction.

A cross-section of the air diffuser 930 has a trapezoidal shape with the shorter parallel side facing the fan 920 and the longer parallel side facing the outlet duct 945. In other words, an air input for the air diffuser 930 is smaller than an air output of the air diffuser 930. The air diffuser 930 gradually widens along its length. As a result, an air diffuser 930 can be defined by the angle of this expansion, measured by a hypothetical apex where the two non-parallel sides of the air diffuser 930 would meet if extended toward the fan 920.

In various embodiments, the angle of expansion of the air diffuser 930 can vary between 20° and 45°. However, smaller angles of expansion for air paths in the air diffuser can provide for more advantageous air diffusion. Therefore, the air diffuser 930 can include one or more baffles 980 that break up the air flow through the air diffuser 930 into separate air passages that each have an expansion angle smaller than the expansion angle of the air diffuser 930 as a whole. For example, a single 30° air diffuser 930 could have two baffles 980 that create three separate air passages that are 10° each. Many other arrangements are possible by modifying the number and position of the baffles 980. The angles of the air passages created by the baffles 980 in the air diffuser 930 can be the same for each passage or may differ among the passages as set forth with respect to the air diffusers 130, 230 in FIGS. 1 and 2.

The baffles 980 are configured and operate similarly to the baffles 180 in the first embodiment save that they may be oriented or arranged differently.

Since the separation plate 925 is perpendicular to the first direction and the air diffuser 930 is not arranged to deflect the diffused air 990 from the first direction, the air diffuser 930 may be symmetrical around the first direction.

Because the fan 920 is not tilted at a tilt angle and the air diffuser 930 does not deflect the diffused air 990 from the first direction, the air diffuser 930 must be longer than the air diffusers 130, 230 in FIGS. 1 and 2 to achieve the same amount of pressure recovery in the diffused air. This is because the conditioned air 970 discharge from the fan is concentrated on one end of the output of the fan 920, requiring a longer distance to equalize through the non-deflected air diffuser 930. As a result, all other things being equal, the air handler 900 will be longer in a direction between the air inlet duct 110 and the air outlet duct 945 than either the air handler 100 or the air handler 200, which do deflect the diffused air 190, 290.

The heater coil 940, the outlet duct 945, and the air handler control box 250 operate in manners comparable to the heater coil 940, the outlet duct 945, and the air handler control box 950 in the first embodiment. As with the first embodiment, the heater coil 940 need not be operated in every operation mode and could be eliminated in some alternate embodiments.

Although the embodiment of FIG. 9 shows the fan 920 being located between the heating and cooling coil 115 and the separation plate 925, this is by way of example only. Alternate embodiments could alter the position of the fan 920 so long as it moves air through the air handler 900 in an efficient manner. In embodiments in which the location of the fan 920 is altered, the location of the diffuser 930 would likewise be altered to diffuse the air expelled from the fan 920 such that the formation of eddies and vortices can be reduced.

Method of Operating an Air Handler

Figure 10:
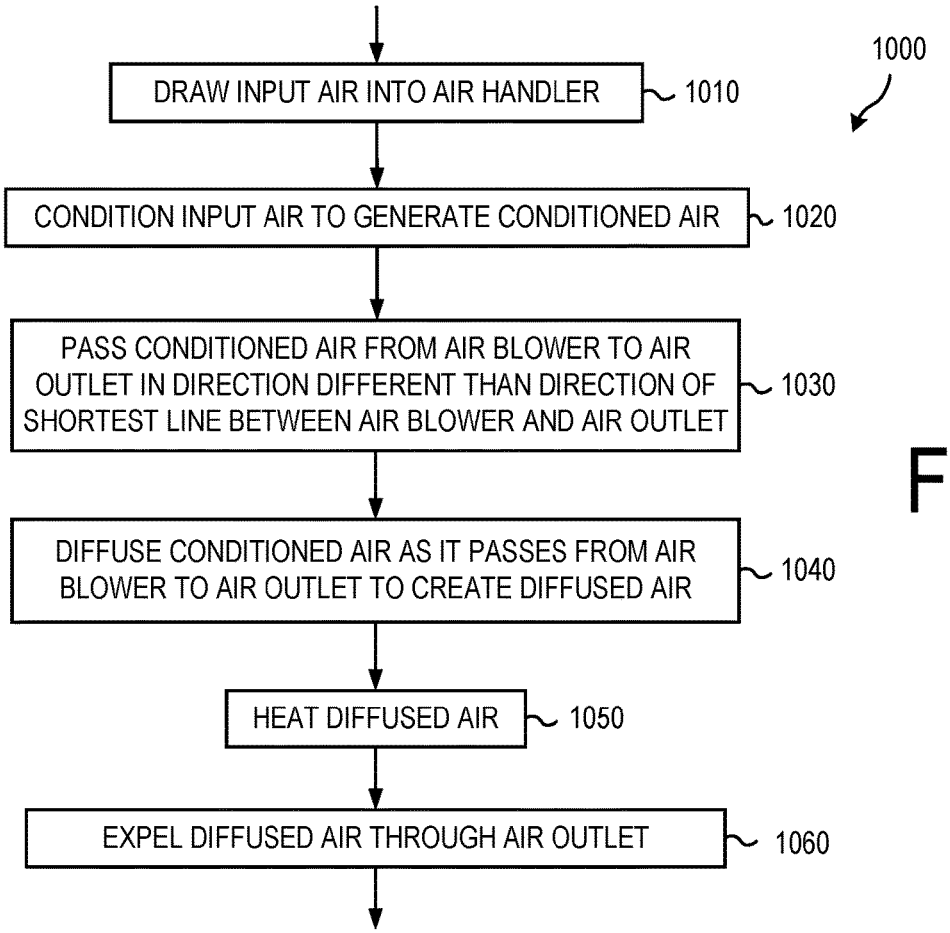
FIG. 10 is a flow chart showing the operation of an air handler according to disclosed embodiments.

FIG. 10 is a flow chart 1000 showing the operation of an air handler according to disclosed embodiments.

Operation begins when input air (inlet air) is drawn into an air handler (1010). This can be accomplished by operating an air blower (fan) inside the air handler.

The input air is then conditioned in the air handler to generate conditioned air (1020). This air conditioning can involve either heating the input air in a heating mode or cooling the input air in a cooling mode.

The conditioned air is drawn into an air blower and passed from the air blower to an air outlet in a second direction different than a first direction of a shortest line between the air blower and the air outlet (1030). In other words, the conditioned air passes from the air blower to the air outlet via a path other than the shortest straight line between the air inlet and the air outlet.

The conditioned air is diffused as it passes from the air blower to the air outlet to create diffused air (1040). In other words, the conditioned air is mixed to recover pressure that might otherwise be lost to eddies and vortices in the conditioned air. This can be achieved by passing the conditioned air through an air diffuser, as disclosed above, which passes conditioned air along an air path that gradually widens between an input of the air diffuser and an output of the air diffuser. In this way, the resulting static pressure of the diffused air can be increased without a corresponding increase in the operating speed of the air blower.

Because the conditioned air has been passed from the air blower to the air outlet in the second direction, which is different from the first direction, air blown from the air blower that might have been concentrated along one side of a direct air path between the air blower and the air outlet will instead be directed diagonally across the direct air path between the air blower and the air outlet, allowing the diffuser to more efficiently recover pressure from the conditioned air as it transforms the conditioned air to the diffused air.

The diffused air may then be heated (1050) if necessary. This can be done, for example, if the conditioning of the air involved cooling it to a temperature lower than a desired temperature set point to dehumidify the air. By heating the diffused air, it can be brought back to a desired temperature set point before being provided to the remainder of an air-conditioning system. This operation is not necessary in every system or even in every operation and may be omitted in some embodiments.

Finally, the diffused air is output from the air handler through an air outlet as output air (outlet air) to the remainder of the air conditioning system (1060).

By diffusing the air as it passes through the air handler, this operation increases the static pressure of the output air without a required an increase in the airspeed (and thus power consumption) of the air blower (fan) in the air handler. When a specific static pressure is required at the outlet port, this allows the disclosed operation to provide the desired static pressure at the outlet port using a lower air speed for the air blower than a comparable system without air diffusion or deflection of the conditioned air between the air blower and the air outlet. This lower airspeed translates into less power consumption by the air blower and thus the air handler in general.

Figure 11:
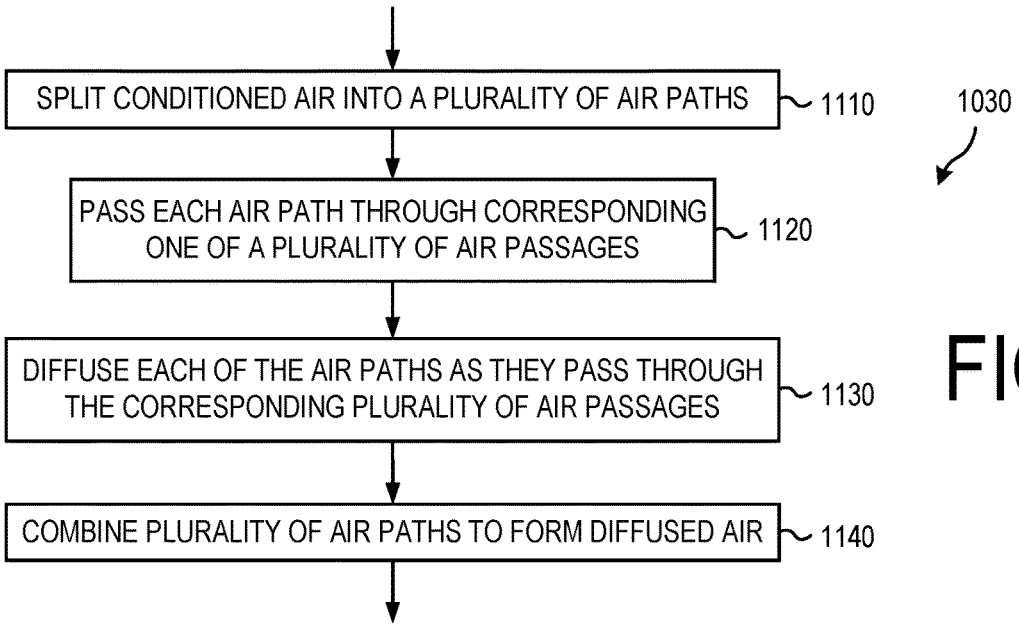
FIG. 11 is a flow chart showing the operation of passing conditioned air from a blower to an air outlet from FIG. 10 according to disclosed embodiments.

FIG. 11 is a flow chart showing the operation 1030 of passing conditioned air from a blower to an air outlet from FIG. 10 according to disclosed embodiments.

The operation 1030 begins by splitting the conditioned air into a plurality of separate air paths (1110).

Each of these air paths will pass through one of a plurality of separate air passages (1120).

The conditioned air passing through each of these separate air passages will be individually diffused in the corresponding air passage (1130). This can be achieved by having each air passage gradually widen as it passes from an air input to an air output.

Once the air in each air path has been properly diffused, the air outputs from the respective air paths are then combined to form the diffused air (1140). By splitting the conditioned air into multiple air paths, each air path can be more efficiently diffused along the same distance as compared to the diffusion of the entire conditioned air along a single air path.

The various embodiments which demonstrate a method for controlling an air handler have been discussed in detail above. It should be further noted that the above-described processes can be stored as instructions in computer-readable storage medium. When the instructions are executed by a computer (e.g., a processor in an air handler control box 150, 250, 950), for example after being loaded from a computer-readable storage medium (e.g., a memory in an air handler control box 150, 250, 950), the process(es) are performed. In one or more embodiments, a non-transitory computer readable medium may be provided which comprises instructions for execution by a computer, the instructions including a computer-implemented method for controlling an air-conditioning system to defrost a condenser coil, as described above. The non-transitory computer readable medium may comprise, for example, a read-only memory (ROM), a random-access memory (RAM), a programmable ROM (PROM), and/or an electrically erasable read-only memory (EEPROM).

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

The invention claimed is:

1. An air handler, comprising: an air inlet configured to pass input air into the air handler; a heating and cooling coil configured to exchange heat with the input air as the input air passes over the heating and cooling coil to generate conditioned air; an air diffuser configured to diffuse the conditioned air to generate diffused air; an air outlet configured to expel the diffused air as outlet air; an air blower configured to draw the input air into the air handler, pass the input air over the heating and cooling coil, pass the conditioned air through the diffuser, and expel the diffused air through the air outlet as output air; and an air-handler controller configured to control operation of the heating and cooling coil and the air blower; and a heater coil located between the air diffuser and the outlet and configured to heat the diffused air before providing it as outlet air, wherein the air diffuser contains one or more baffles configured to create two or more air passages, the air passages being configured to control the expansion and conversion of kinetic energy of the conditioned air to generate the diffused air, a first direction represents a direction of a shortest line between the air blower and the outlet, the air diffuser is further configured such that air passing through the air diffuser passes in a second direction displaced at from the first direction by a deflection angle, and the deflection angle is greater than 5°, a diffuser angle between a first wall of the air diffuser and a second wall of the air diffuser is between 20° and 50°, the one or more baffles are arranged between the first wall and the second wall such that the two or more air passages each define a corresponding passage angle, and a sum of all the passage angles equals the diffuser angle.

2. The air handler of claim 1, wherein an output of the air blower is tilted at a blower tilt angle from a direction perpendicular to the first direction such that the conditioned air blown from the air blower flows in a third direction that is the blower tilt angle from the first direction, and the blower tilt angle is greater than 0°.

3. The air handler of claim 2, wherein the blower tilt angle is the same as the deflection angle.

4. The air handler of claim 2, wherein
the deflection angle is between 10° and 30°.

5. The air handler of claim 2, wherein
the third direction is the same as the second direction.

6. The air handler of claim 1, wherein the corresponding passage angles are all equivalent.

7. The air handler of claim 1, wherein at least two of the corresponding passage angles are different.

8. The air handler of claim 1, wherein
the air diffuser and blower are formed as separate devices.

9. The air handler of claim 1, wherein
the air diffuser and the blower are formed as a unified device.

10. An air handler, comprising:
an air inlet configured to pass input air into the air handler;
a heating and cooling coil configured to exchange heat with the input air as the input air passes over the heating and cooling coil to generate conditioned air;
an air diffuser configured to diffuse the conditioned air to generate diffused air;
an air outlet configured to expel the diffused air as outlet air;
an air blower configured to draw the input air into the air handler, pass the input air over the heating and cooling coil, pass the conditioned air through the diffuser, and expel the diffused air through the air outlet as output air; and
an air-handler controller configured to control operation of the heating and cooling coil and the air blower,
wherein
a first direction represents a direction of a shortest line between the air blower and the outlet,
the air diffuser is further configured such that air passing through the air diffuser passes in a second direction displaced from the first direction by a deflection angle,
an output of the air blower is tilted at a blower tilt angle from a direction perpendicular to the first direction such that the conditioned air blown from the air blower flows in a third direction that is the blower tilt angle from the first direction,
the air diffuser configured to divide flow of the conditioned air to generate the diffused air,
the blower tilt angle is greater than 0°, and
the deflection angle is greater than 5°.

11. The air handler of claim 10, wherein
the third direction is the same as the second direction.

12. The air handler of claim 10, wherein
the blower tilt angle is greater than 10°.

13. The air handler of claim 10, wherein
the deflection angle is between 10° and 30°.

14. The air handler of claim 10, wherein
a diffuser angle between a first wall of the air diffuser and a second wall of the air diffuser is between 20° and 50°.

15. A method for operating an air handler, the method comprising: drawing input air into the air handler through an air inlet; conditioning the input air to generate conditioned air; diffusing the conditioned air to create diffused air while passing the conditioned air from an air blower to an air outlet; expelling the diffused air as output air through the air outlet, wherein a first direction represents a direction of a shortest line between the air blower and the outlet, during the operation of diffusing the conditioned air, the conditioned air flows in a second direction displaced at from the first direction by a deflection angle, during the operation of diffusing the conditioned air, the conditioned air is separated into two or more air paths, and the deflection angle is greater than 5°, the two or more air paths run along parallel air passages, each of the parallel air passages defining a corresponding passage angle from a corresponding air passage start to a corresponding air passage end, a sum of all the passage angles is between 20° and 50°, and at least two of the corresponding passage angles are different.

16. The method of claim 15, wherein
the deflection angle is between 10° and 30°.

* * * * *